United States Patent [19]

Soong

[11] 4,437,662

[45] * Mar. 20, 1984

[54] STRING LOAD APPORTIONED RACKET

[76] Inventor: Tsai C. Soong, 1839 Jackson Rd., Penfield, N.Y. 14526

[ * ] Notice: The portion of the term of this patent subsequent to Jun. 8, 1999 has been disclaimed.

[21] Appl. No.: 376,592

[22] Filed: May 10, 1982

Related U.S. Application Data

[63] Continuation-in-part of Ser. No. 228,577, Jan. 26, 1981, Pat. No. 4,333,650, which is a continuation-in-part of Ser. No. 136,907, Apr. 3, 1980, abandoned, which is a continuation-in-part of Ser. No. 120,160, Feb. 11, 1980, abandoned, which is a continuation-in-part of Ser. No. 68,572, Aug. 22, 1979, abandoned.

[51] Int. Cl.[3] ..... A63B 51/00

[52] U.S. Cl. ..... 273/73 D; 273/73 G

[58] Field of Search ..... 273/73 R, 73 C, 73 D, 273/73 E, 73 J, 73 G, 73 H

[56] References Cited

U.S. PATENT DOCUMENTS

| | | | |
|---|---|---|---|
| 2,206,548 | 7/1940 | Goerke | 273/73 E |
| 3,999,756 | 12/1976 | Head | 273/73 D X |
| 4,196,901 | 4/1980 | Durbin | 273/73 G |

FOREIGN PATENT DOCUMENTS

| | | | |
|---|---|---|---|
| 2752624 | 5/1979 | Fed. Rep. of Germany | 273/73 C |
| 413753 | 6/1910 | France | 273/73 D |

*Primary Examiner*—Richard C. Pinkham
*Assistant Examiner*—Matthew L. Schneider
*Attorney, Agent, or Firm*—Stonebraker, Shepard & Stephens

[57] ABSTRACT

Longitudinal strings 15 or 25 of tennis or other sports rackets 10 or 20 are lengthened to be at least 30% longer than transverse strings 17 or 27 and are strung with at least 30% more tension than the transverse strings. The longitudinal strings are also functionally related in length and tension to the transverse strings to effectively apportion to the longer longitudinal strings from approximately half to substantially more than half of the string force for decelerating a ball pentrating the string network as the ball is hit. The functional relationship for selecting appropriate lengths and tensions for the longer and shorter strings is mathematically derived, analyzed, and related to practical working mechanics of a string network. The advantages of lengthening, tightening, and apportioning more of the load to the longitudinal strings include a higher coefficient of restitution for the string network; a larger and more responsive sweet spot area; smaller hysteresis losses from string stretching; less interstring friction and ball deformation; higher velocity ball rebound; better shot control; and less torque shock to the arm of the user from off center hits.

11 Claims, 9 Drawing Figures

"DUNLOP VOLLEY II" Frame

"PRINCE CLASSIC" RACQUET Frame

STRING LOAD APPORTIONED RACKET

RELATED APPLICATIONS

This application is a continuation-in-part of my parent application Ser. No. 228,577, filed Jan. 26, 1981, now U.S. Pat. No. 4,333,650 entitled STRING LOAD APPORTIONED RACKET, which has been allowed and will issue as a patent. The parent application in turn is a continuation-in-part of the last of a succession of earlier applications, all entitled LONG STRING RACKET, and each predecessor application being abandoned upon the filing of a succeeding application, as follows:

| Sn. No. | Filed | |
|---|---|---|
| 068,572 | 8/22/79 | original |
| 120,160 | 2/11/80 | CIP |
| 136,907 | 4/03/80 | CIP |

INCORPORATION BY REFERENCE

The full disclosure of grandparent application Ser. No. 136,907 is hereby incorporated by reference into this application.

BACKGROUND OF THE INVENTION

This invention involves several discoveries reached by experience, experimentation, and supportive analysis to improve significantly on the string network of tennis rackets, racquetball rackets, and other sport rackets. The effort generally is directed toward determining optimum string parameters and arrangements to make a string network that is more effective, efficient, and responsive in applying hitting force to a ball.

The invention not only recognizes that longer strings have important advantages, but it recognizes why longer strings work better and how they can be arranged to produce improved results. It includes several suggestions for extending longitudinal strings into the throat or shank region of a racket to have a substantially longer strung length; and it proposes several different arrangements for fanning out, guiding, and anchoring longer longitudinal strings.

The invention also recognizes that longer longitudinal strings should be strung with a higher tension than shorter transverse strings, and the invention determines both the reasons for and the extent of the higher tension for the longer strings to achieve a significantly better working relationship within the string network.

Investigation of the dynamics of string mechanics by using experimentation, mathematical analysis, and play experience has produced considerable verified information on truly effective lengths and tensions for the longitudinal and transverse strings to work effectively together. The information reveals that the necessarily shorter but equally tensioned transverse strings in prior art rackets bear much more than half of the load in hitting a ball. This not only wastes the superior capacity of the longitudinal strings to bear the ball-hitting load, but also contributes to twisting torque and shock delivered to the player's arm from shots hit off center.

The invention not only recognizes the advantages of longer longitudinal strings strung at higher tension than the shorter transverse strings, but also quantifies an approximate functioning relationship that balances the greater tension and length of the longitudinal strings with the lesser tension and length of the transverse strings effectively to apportion more of the ball-hitting load to the longitudinal strings. This gives a string network a higher coefficient of restitution imparting a higher velocity to a rebounding ball, spreads the higher coefficient of restitution throughout a wider network area, reduces losses from stretching and rubbing strings and deforming the ball, and lessens torque shock to the arm of the player. Tennis rackets strung according to the invention have been made, tested, and used in play to verify measureable data, confirm analysis, and establish subjectively that the invention produces better control, higher velocity returns, and a lively and shock-free feel in shot making.

SUMMARY OF THE INVENTION

My discoveries about functionally interrelating string lengths and tensions for tuning string networks to improved performance in hitting balls applies to tennis and other sports rackets. These have a hand grip joined to a frame supporting a string network that extends throughout a ball-hitting region spaced from the grip, and the frame has a shank region extending from the grip and flaring outward in a throat region and extending around a generally oval ball-hitting region spanned by transverse and longitudinal strings.

I have found that at least a central plurality of the longitudinal strings, and preferably all the longitudinal strings, should have a strung length at least 30% longer than the transverse strings. A preferred way of accomplishing this is to extend the longitudinal strings into the throat or shank region of the frame and possibly as far as the region of the grip. These longer longitudinal strings can either fan outward across the ball-hitting region or be approximately parallel in the ball-hitting region and guided in the throat region to angle toward the shank region.

I have also found that the longer longitudinal strings should be strung with at least 30% more tension than the transverse strings. This not only tunes the longer and shorter strings to operate harmoniously, but it also converts more of the ball-hitting force to initial string tension and reduces losses that occur from ball deformation, string stretching, and interstring friction.

I have also discovered an important functional relationship between the longer strung length and greater tension of the longer longitudinal strings and the shorter strung length and lesser tension of the transverse strings. String lengths and tensions selected according to this relationship effectively apportion to the longer longitudinal strings from approximately half to substantially more than half of the string force that decelerates a ball penetrating the string network as the ball is hit. In other words, the greater length and tension of the longitudinal strings is selected relative to the lesser length and tension of the transverse strings to place nearly half or considerably more than half of the ball-hitting load on the longitudinal strings in contrast to prior art rackets that place substantially more than half of the ball-hitting load on the transverse strings.

This relationship significantly improves over a conventional string network in several ways. The longer longitudinal strings bear more of the load in hitting a ball and have a greater influence on the shot; and since the longer longitudinal strings have a greater capacity to store and return energy to the ball than the shorter transverse strings, this alone produces considerable improvement. Longer strings stretch less than shorter strings in deforming as a ball penetrates the string network so that longer strings lose less energy in string stretching and interstring friction. The higher strung tension of the longer strings also provides more of the ball resisting force and further reduces the need for string stretching. The longer, tauter strings stop a ball with less force and more deformation to reduce ball deformation and the energy loss that entails. Moreover, longitudinal strings anchored nearer the longitudinal axis of the racket are geometrically more suited to bearing the ball-hitting load than the transverse strings anchored at the sides of the frame and transmitting more twisting shock to the player from off center hits. Advantages related to these include a more responsive sweet spot area, a higher coefficient of restitution of the string network, more control and velocity for shots, and less vibration.

DRAWINGS

Figure 6:
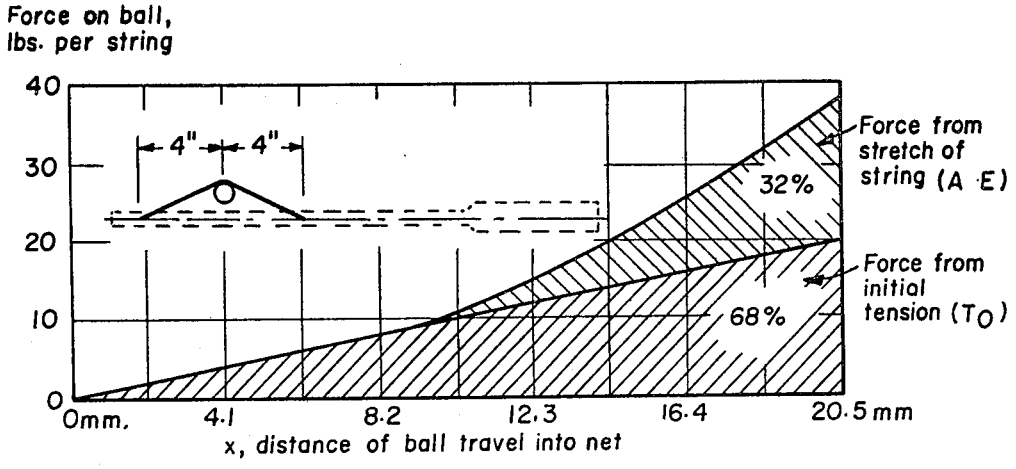
FIG. 6 (prior art)
Figure 7:
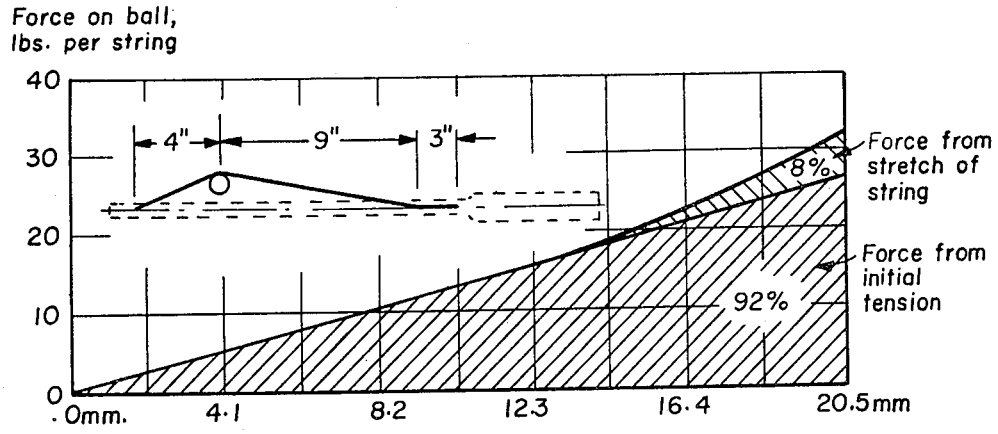
Figure 8:
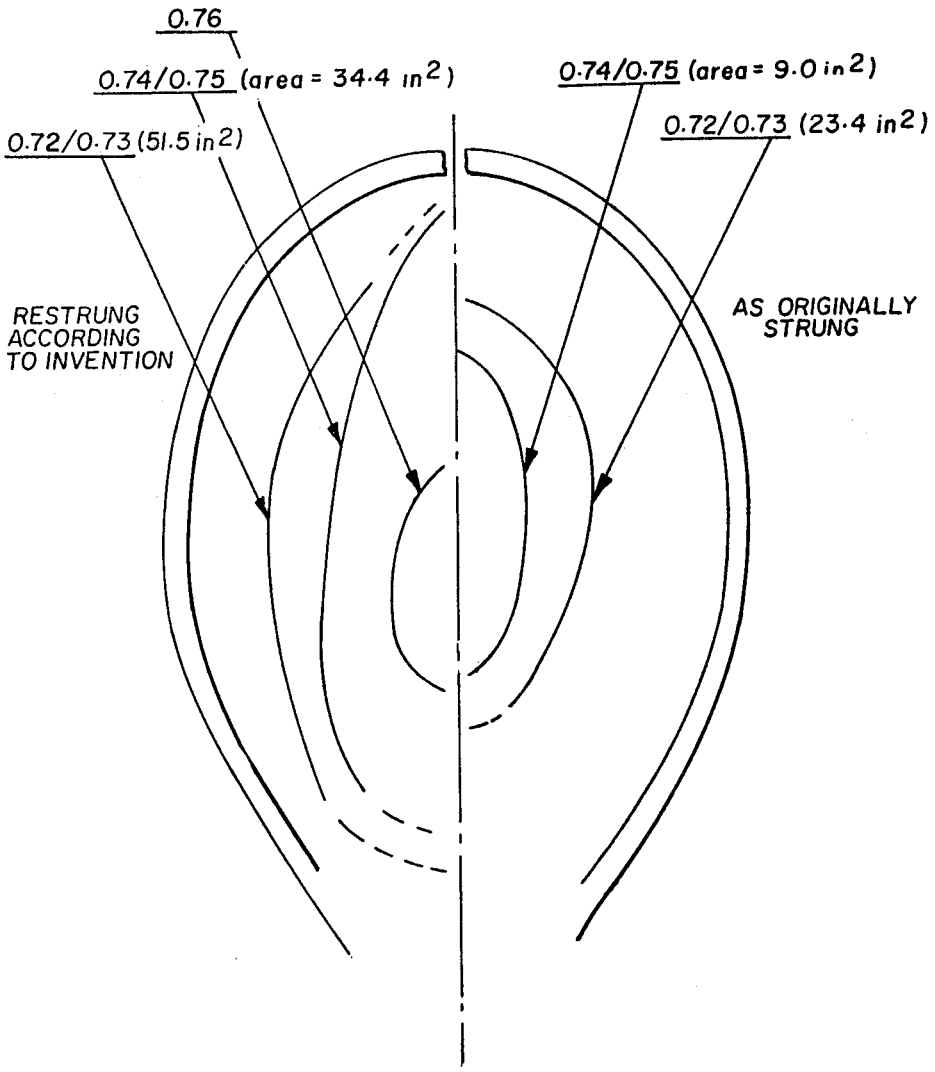
Figure 9:
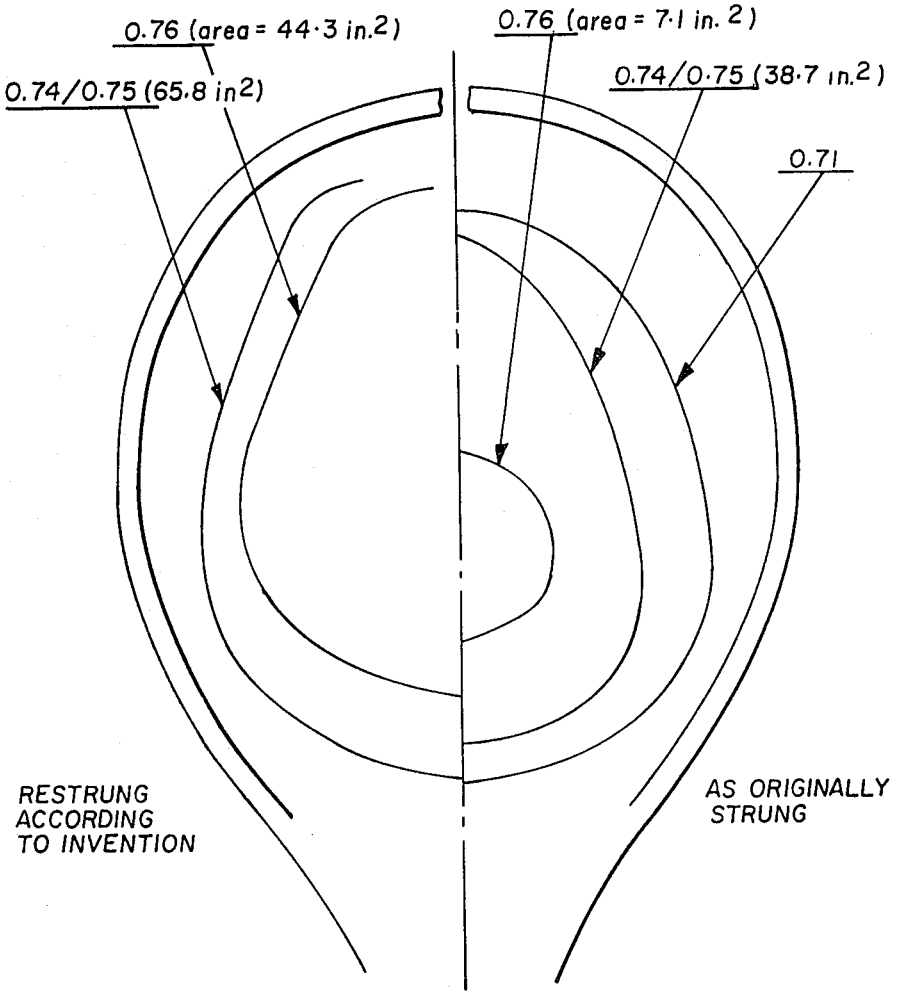

FIGS. 6 and 7 are graphic diagrams of string forces involved in hitting a ball respectively with a prior art racket and with a racket strung according to my invention; and FIGS. 8 and 9 are scale schematic diagrams comparing experimentally determined coefficient of restitution areas using representative frames strung according to my invention on the left and according to the prior art on the right.

DETAILED DESCRIPTION GENERALLY

Most of the recent improvements in tennis rackets have involved frame and racket structure, rather than string network. Considerable work has been done on the size and location of the sweet spot, more properly called the center of percussion, where the impact of the ball is least felt by the player. This is affected by the geometry, shape, size, rigidity, and weight distribution of the frame, including the throat and handle, and only to a lesser extent by string tensions and lengths.

Except for a few changes in string network size, string materials, and variably spaced strings, string networks have not been varied. The present state of the art of racket making universally applies the same tension to transverse strings and longitudinal strings, even though racket frames provide a generally oval ball-hitting region so that longitudinal strings have a longer average length than transverse strings.

RACKET AND BALL MECHANICS

Understanding the invention requires a general understanding of racket and ball mechanics. When a ball and string network collide, the kinetic energy carried by the ball due to its velocity relative to the racket is divided into three parts. The first part is spent on bending the frame, the second is consumed in flattening the ball, and the third is spent on penetrating the string network, which increases the string tension and dents the net. Among the three parts, the energy spent on bending the frame is almost a total loss. The ball contacts the network for only two to three throusandths of a second, and the frame is still bent when the ball rebounds from the network; so that energy stored in the bent frame is not returned quickly enough to add to the rebound of the ball. The energy spent in deforming the ball, due to the final impact force between the network and the ball is at least partially lost, because the ball is still partially deformed when it rebounds from the string network so that some of the energy spent in deforming the ball is not recovered in rebounding.

The energy losses from frame bending and ball deforming can be seen clearly from high speed photographs and are generally recognized as an unfavorable part of racket mechanics. Improvements in tennis balls to retain a high internal pressure and use of high strength materials such as composite, metal, and boron reinforced synthetics to make racket frames light but rigid are both efforts to reduce these losses of dynamic energy.

The third part involving the energy stored in the string network as the ball penetrates it on impact and the reaction of the string network in returning kinetic energy to the rebounding ball is known to be important; and different string materials and tensions have explored this. However, apart from a few suggestions that were never adopted in the art, string networks have been limited to the oval ball-hitting region and have used transverse and longitudinal strings arranged at right angles to each other, formed of the same material, and strung with the same tension.

STRING MECHANICS

The tension that develops in a string on impact with the ball consists of two components—an initial strung tension $T_o$ and an additional tension $AE(x/L_1)^2$ from stretching or elongating the string, where A is the string's cross-sectional area and E is its Young's modulus, x is the ball penetration, and $L_1$ is the half length of the string.

These two components combine to form a retarding force that resists the advance of the ball while storing up the diminishing kinetic energy of the ball. A differential equation describing this dynamic equilibrium taken from Timoshenko, "Vibration Problems in Engineering", D. VanNostrand Co., New York, p. 116, is:

$$F = m\frac{d^2x}{dt^2} = -\left[T_o\frac{x}{L_1} + AE(x/L_1)^3\right] \quad (1)$$

where F is the force acting on the ball from the string, and the negative sign indicates that it is a decelerating force.

It is important to recognize that the initial tension $T_o$ term is much larger than the stretching term and is linearly proportional to the ball penetration distance x. Initial string tension thus acts much like a linear spring in receiving and storing the kinetic energy of the ball. The stretching term AE is small since it is proportional to the cube of $x/L_1$ which is very small when ball penetration x is small. However, when the relative speed of the ball is high and its penetration is large, the stretching term AE becomes increasingly significant.

My invention recognizes the fact that a longer string with a large $L_1$ reduces the influence of the stretching term AE and indirectly increases the contribution of initial tension $T_o$, both of which benefit the performance of the network. Repeated stretching and unstretching of a string cause hysteresis loss from molecular friction within the string, and string stretching also causes rubbing, wear, and friction loss as strings move against one another. This suggests that the stretching term AE should be kept as small as possible, and that long strings are the best way to achieve this.

When string length increases, the initial strung tension $T_o$ should also be increased so that the $T_o/L_1$ term is not reduced. This results in a longer, tauter string with a high tension resistance to penetration of a ball and a much smaller portion of ball resistance derived from string stretching. Also, from the vibrational point of view, string tension should increase proportionally with increases in string length so both strings vibrate at the same frequency.

Since the length of the transverse or cross strings is limited by the width of the racket frame, only the longitudinal strings can be made longer to take advantage of higher tension resistance. Longer longitudinal strings can be extended into the throat, shank, and even into the handle to provide a substantially longer strung length than the transverse strings.

My previous applications suggest several anchorage and guidance arrangements for extending longitudinal strings into the shank or grip region of a racket, and many other possibilities are probably workable. The two most preferred arrangements are schematically shown in FIGS. 1 and 2.

Figure 1:
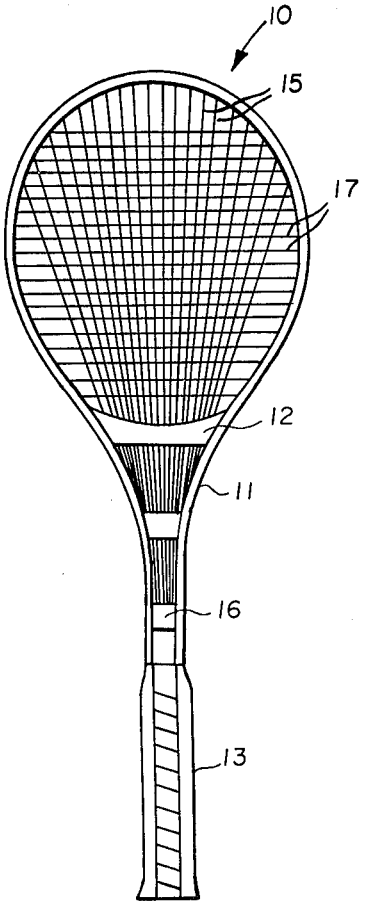
FIGS. 1 and 2 are respective plan views of alternative preferred embodiments of rackets strung according to my invention.

Longitudinal strings 15 of a preferred racket 10 of FIG. 1 fan outward across the ball-hitting region from an anchorage 16 in shank 11. Anchorage 16 can be positioned anywhere from throat 12 to grip 13, depending on the length and tension desired for strings 15.

Figure 2:
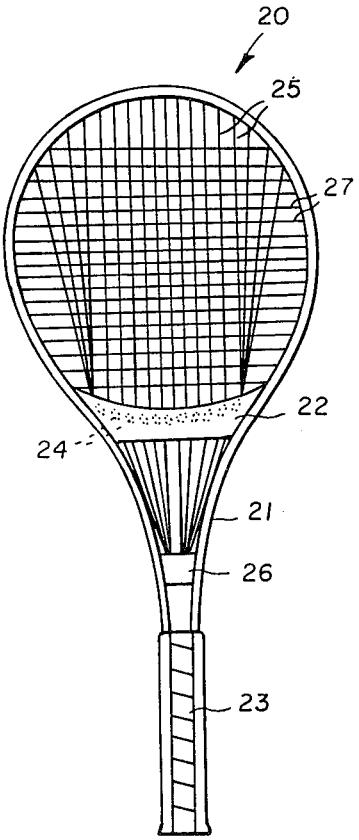

The other preferred racket 20 of FIG. 2 has longitudinal strings 25 that either extend axially parallel or diverge slightly across the ball-hitting region from a throat piece guide 22 having guide elements 24 that angle the strings between their anchorage 26 in shank 21 and their course across the ball-hitting region. Again, anchorage 26 can be positioned along shank 21 or within grip 23. Side strings can be parallel and fastened along the frame, or slightly inclined as shown.

The embodiment of FIG. 2 looks more conventional and might be better received, but its throat guide 22 produces some friction loss. The embodiment of FIG. 1 is preferred not only for reducing friction, but for the additional advantage of reducing twisting torque from off center hits. Throat guide 22 can also provide an anchorage for longitudinal strings extending somewhat deeper into the throat region than is ordinary. The tendency of different string lengths and tensions to produce a desired performance is explained more fully below.

Both the embodiments of FIGS. 1 and 2 arrange the longer longitudinal strings 15 or 25 to bear more of the ball-hitting load than the transverse strings 17 or 27, and thus reduce the twisting torque from off center hits. But the fan out arrangement of FIG. 1 spaces the longitudinal strings closer together in the central region where most balls are hit and disposes strings 15 within a closer average distance from the racket axis to keep twisting torque to a minimum. This relieves the so-called tennis elbow caused by repeated twisting movement of the player's arm from ball-hitting shock.

MATHEMATICAL ANALYSIS

The practical possibility of longer longitudinal strings strung at much higher tensions raises the issue of the optimum relationship between longer and shorter strings. This required mathematical analysis deriving a more realistic dynamic equation and using a more realistic mathematical model to determine the effect of changing string parameters on the load distribution to different strings.

Figure 5:
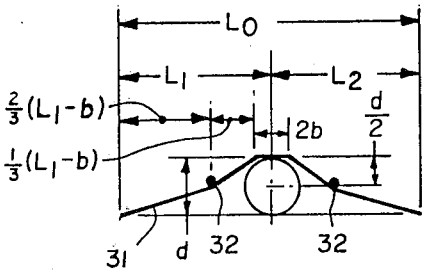
FIGS. 3–5 are respective plan, side elevation, and end elevation views of a schematic racket model for analyzing string networks according to my invention.
Figure 3:
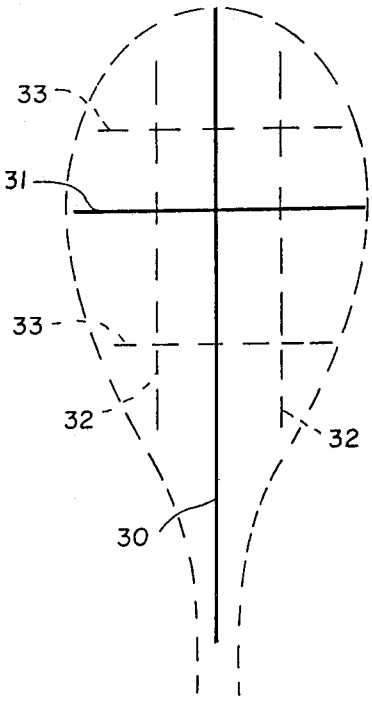
Figure 4:
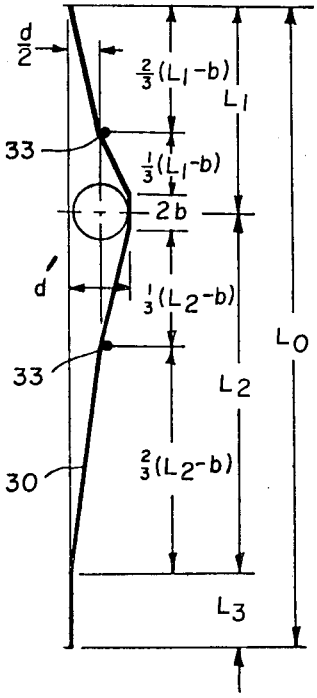

FIGS. 3–5 show a mathematical model simplifying and approximating the action of a central longitudinal string 30 and a central transverse string 31 perpendicular to each other and elastically supported by other strings in the network to be deformed as shown when hitting a ball. The string width 2b adjacent the ball simulates the string portion that conforms with the flattened surface of the ball when the ball penetrates into the string network. The overall string lengths $L_o$ are divided into subscript portions to account for different lengths of string depressed by different amounts. The broken lines 32 and 33 simulate the elastic support from other strings supporting the two string system shown in solid lines, and the penetration d of the ball into the string network in the area of contact also dents the elastic supporting strings 32 and 33 by d/2, which is arbitrarily assumed.

Dynamic equations based on the model of FIGS. 3–5 as explained below approximate more closely the complex realities of the interaction between longitudinal and transverse strings. These equations aid in determining appropriate values for string lengths and tensions to achieve optimum string network response.

The elastically supported, two string network of FIGS. 3–5 resists the force represented by the mass m of the ball traveling at an initial relative velocity $V_o$ in decelerating the ball as the two strings share the load. With r representing the percentage of the load borne by the longitudinal string, and with subscripts c and L referring respectively to parameters of the cross string 31 and the longitudinal string 30, a more involved analysis arrives at the following equations to describe the dynamic equilibriums of the two strings under various string lengths and tensions:

$$r\,mV_o^2 - (pT_o)_L d^2 - \left(\frac{AE}{2}q\right)_L d^4 = 0 \tag{2a}$$

$$(1-r)mV_o^2 - (pT_o)_c d^2 - \left(\frac{AE}{2}q\right)_c d^4 = 0 \tag{2b}$$

The parameters p and q are given as:

$$p=(3/2)[1/(L_1-b)+1/(L_2-b)] \tag{3a}$$

$$q=(27/32)[1/(L_1-b)+1/(L_2-b)]^2/L_o \tag{3b}$$

For the cross string, $L_2=L_1$ and $L_o=2L_1$.

The maximum penetration d is found for the longitudinal string from:

$$d_L = \sqrt{\frac{(pT_o)_L}{(AEq)_L}\left\{\sqrt{1+\frac{2rmV_o^2(AEq)_L}{(pT_o)_L^2}}-1\right\}} \tag{4a}$$

which bears a percentage r of the ball-hitting load, and is found for the transverse string from:

$$d_c = \sqrt{\frac{(pT_o)_c}{(AEq)_c}\left\{\sqrt{1+\frac{2(1-r)mV_o^2(AEq)_c}{(pT_o)_c^2}}-1\right\}} \quad (4b)$$

which bears a percentage 1−r of the ball-hitting load.

The string force resisting the advance of the ball increases with penetration of the ball into the string network and reaches its maximum value when the ball is stopped. At that instant, the deceleration is maximum, and the force $F_o$ is greatest. This maximum force, $rF_o$ on the long string and $(1-r)F_o$ on the transverse string, which determines the final deformation of the ball, is given respectively by:

$$rF_o=(pT_o)_L d+(AEq)_L d^3 \quad (5a)$$

$$(1-r)F_o=(pT_o)_c d+(AEq)_c d^3 \quad (5b)$$

where $F_o$, which is equal to the mass times the deceleration, is the combined force on the ball from the two string system, r is the load percentage borne by the long string 30, 1−r is the load percentage borne by the cross string 31, and d is the maximum penetration by the ball. For the same penetration, a smaller $F_o$ will deform the ball less and hence is preferable.

It is quite clear from the mechanics of the string network that the consistent practice of the prior art in stringing the longitudinal and transverse strings with the same tension has forced the shorter transverse strings to bear a much larger portion of the ball-hitting load. The above equations give an approximation of the load disparity between the two strings and show the tendency of present rackets to overburden the transverse strings. For example, the Prince racket with its over sized head and relatively long 11 inch transverse strings working with 13 inch longitudinal strings apportions 57% of the load to the transverse strings and only 43% to the longitudinal strings when both strings are strung at the recommended tension of 72 pounds. The corresponding load distribution for the Dunlop Volley II is 56% on the transverse strings and 44% on the longitudinal strings. The preponderance of the ball-hitting load on the transverse strings is substantially more than half for all rackets presently being sold.

Calculations using the above equations to approximate a realistic example comparing conventional stringing with longer and tauter longitudinal strings balanced with transverse strings according to the invention help clarify the importance of the inventive improvement. Longitudinal string force in a conventionally strung prior art racket having equal tension on longitudinal and transverse strings as shown in FIG. 6 is compared with a racket having longer and tauter longitudinal strings balanced with the transverse strings according to the invention as shown in FIG. 7. The comparison assumes a tennis ball traveling at a velocity of 50 miles per hour and hitting a stationary racket and string network. It also assumes that four transverse strings and four longitudinal strings are in contact with the ball and provide the force required for stopping the ball.

The previous equations used with these assumptions show that the mass of the ball impacting on the contacted strings penetrates the network to a distance of 20.5 millimeters for both the prior art and the inventive rackets using the indicated string lengths. This makes the duration of ball contact and control of the shot about equal for each racket. Both transverse and longitudinal strings in the prior art racket are tensioned at 50 pounds, and the inventive racket tensions the transverse strings at 50 pounds and the longitudinal strings at 93 pounds.

The graphs of FIGS. 6 and 7 plot the impact force against the penetration of the ball into the string networks and divide the ball-resisting force into the portion attributable to initial string tension $T_o$ and the portion attributable to stretching of the string AE as previously explained. The results clearly show that longer strings at higher tensions allocate a much smaller portion of the ball-stopping force to string stretching. The results also show that the maximum impact force at the end of the ball penetration is higher for the prior art racket than for a racket strung according to the invention. Since the ball penetration is the same for both string networks, shot control is the same; and the lesser maximum force for the inventive network means a more efficient rebound. Both of these differences represent significant qualitative advantages for the inventive network.

Reducing the force involved in stretching strings reduces losses that necessarily occur from internal friction as a string stretches and from interstring friction as strings rub together. It also reduces string wear and fatigue so that the network lasts longer. Reducing the maximum force required to stop the ball wastes less energy in ball deformation and means a springier, more responsive string network that is more effective in returning energy to the rebounding ball.

Of course, a real racket has a much more complex string network than assumed in these calculations and includes a large number of perpendicular string systems of different lengths and actual tensions. Therefore, the ball load ratios and the analytic relationship between the tension and length should not be taken as absolute. However, the tendency shown by the calculated comparison should and does prove true when applied to real racket string networks.

TEST VERIFICATION

Test measurements have compared string networks strung according to the invention with conventionally strung string networks for two of the best tennis rackets in the current market. Because the invention involves improved performance from an optimally strung network and not an improved shape or configuration of racket or frame, the frames of the two best rackets available were chosen for comparison of stringing efficiency. One is the "Volley II" made by the Dunlop Company as a medium size head racket. The trade magazine "Tennis World" has a special feature report in the April 1980 issue praising this racket as excellent. The other racket is the famed "Prince Classic", an over size head racket made by Prince Manufacturing Company according to U.S. Pat. No. 3,999,756.

Since the relevant comparison involves differences in string networks and not differences in frame structure or weight distribution that effect the overall performance of the racket, the tests were made by clamping the periphery of the racket frame in a horizontal position leaving the string network free, dropping a tennis ball down from a fixed height of 49.2 inches, and accurately measuring the height of the rebound of the ball from the string network. The rebound height was measured by an "Instar" video camera that recorded on magnetic tape and allowed playback on a television to stop the frame showing maximum rebound height. The tests were conducted by Dr. William Parzygnat, who has a PhD in Mechanical Engineering from Cornell University and works to the Xerox Corporation.

Both the Dunlop Volley II and the Prince Classic rackets were first tested with a new nylon string network with uniformly tensioned strings at factory-recommended values of 62 pounds tension for the Volley II and 72 pounds tension for the Prince Classic.

The ball drop tests were made on each racket at different points in the ball-hitting region, and the ball rebound heights were accurately recorded and measured to establish the coefficient of restitution, which is the rebound height divided by the drop height. The results of these tests are drawn in scale and schematically shown in the right hand portions of FIGS. 8 and 9.

Then an identical racket frame was strung with longer longitudinal strings and with string lengths and tensions selected according to calculations. The network strung according to the invention used longitudinal strings anchored in the shank near the grip and fanned out across the ball-hitting region as shown in FIG. 1. To establish string lengths and tensions in these rackets, calculations assumed a relative ball velocity of 50 miles per hour with the ball contacting four transverse strings and four longitudinal strings as previously described. With the ball's weight established at 0.103 pounds (46.7 gm), the mass shared by one transverse string and one longitudinal string is calculated to be 0.0008 lb.-sec.$^2$/ft.

For the regular Volley II racket strung with nylon strings having an AE of 2260 pounds and with both strings tensioned at the factory-recommended 62 pounds, equations 4a and 4b indicate a ball penetration of 0.69 inches or 1.76 centimeters. These same equations suggest that the same racket frame strung according to the invention to achieve the same ball penetration and thereby the same impact duration and shot-making control should tension the 9 inch transverse nylon strings at 42 pounds and use 18 inch longitudinal strings strung at 100 pounds tension on a "Kevlar" string having an AE of 13,000 pounds. This makes the long strings twice as long as the transverse strings and more than twice as taut and substantially changes the load apportionment between the transverse and longitudinal strings. The original factory-strung Volley II racket apportions 56% of the ball-hitting load to the transverse strings and only 44% to the longitudinal strings, while the inventive string network apportions 59% of the load to the longitudinal strings and only 41% to the transverse strings.

Ball drop tests were then made on the Volley II racket strung according to the invention to record and measure the rebound height and the coefficient of restitution at different points in the string network, and the results of these measurements are plotted in scale on the left side of FIG. 8. The test results show a significant improvement.

The inventive string network achieves a 0.76 maximum coefficient of restitution that is higher than any coefficient of restitution attained with conventional stringing for the same racket. The region of the highest coefficient of restitution from 0.74 to 0.75 for conventional stringing is only 9.0 square inches in the center of the network and is enlarged to 34.4 square inches in the inventive network, an increase by a factor of 3.82. An outer region having a smaller coefficient of restitution of 0.72 to 0.73 for the conventionally strung racket amounting to 23.4 square inches was enlarged in the inventive network to 51.5 square inches for an increase by a factor of 2.2. These tests clearly show that the invention substantially improves over the conventional by making the string network generally more lively and efficient in rebounding a ball and by greatly enlarging the most effective areas of the network.

In the test comparison of the Prince racket as illustrated in FIG. 9, calculations suggested that instead of 11 inch nylon transverse strings and 13 inch nylon longitudinal strings both strung at the recommended 72 pounds, the transverse strings should be tensioned at 45 pounds and the longitudinal strings should be extended to 18 inches to an anchorage 1 inch away from the handle grip and should be formed of Kevlar to withstand a higher tension of 100 pounds. This changed the load-bearing ratio from the original stringing placing 57% of the load on the transverse strings and 43% on the longitudinal strings to the inventive stringing that apportions 58% of the load on the longitudinal strings and 42% on the transverse strings.

Ball drop tests were repeated to measure the rebound height and coefficient of restitution of the inventive network as plotted on the left side of FIG. 9. The results show that the invention enlarged the central region with the highest coefficient of restitution of 0.76 from the original 7.1 square inches to 44.3 square inches for an increase by a factor of almost 6.3. The outer area having a coefficient of restitution of 0.74 to 0.75 also enlarged from the original 38.7 square inches to 65.8 square inches for an increase by a factor of 1.7. This improvement represents an enormous increase in the area of highest rebound responsiveness and shows the clear superiority of the inventive network.

The coefficient of restitution values obtained in these tests represent only the comparative efficiencies of the string networks in rebounding the ball, because the racket frames were constrained during the tests and not involved in the interaction. In tests of a Prince racket held at its handle when a ball hits the string network as reported in U.S. Pat. No. 3,999,756, the coefficients of restitution were in the neighborhood of 0.3 to 0.4.

Racket performance depends not only on the string network, but also on frame configuration, material, and weight distribution. So the improvement the invention achieves in the string network may not result in a directly proportional improvement in overall racket performance. On the other hand, the inventive improvement in the network stringing can be applied to existing rackets without additional cost, and the drop tests establish that the invention makes a more efficient string network with better ball-rebounding ability that undoubtedly improves a racket's overall performance. Rackets strung according to the invention have been used extensively by experienced players who have compared them with conventionally strung rackets and reported a subjective impression confirming the test results. Rackets strung according to the invention are lively and responsive, feel definitely "playable", and make well controlled and powerful shots.

The calculations and comparisons between conventional string networks and the inventive string network suggest another reason why the inventive network makes a racket superior. Longer and tauter strings are able to absorb the energy of the ball with less force applied to the ball and consequently reduce deformation of the ball. This increases the ball's rebound speed, because less energy is lost in deforming the ball and more energy stored in the strings is returned to the ball as kinetic energy.

Considering the Volley II racket as an example, calculations with equations 5a and 5b show that the conventional string system stopped the ball with a final load or peak force of 62 pounds from the two strings. This seemingly large force lasts only for a brief duration, because the total contact time between the ball and the network is only two to three thousandths of a second. In comparison with the inventive string network, the transverse strings at 42 pounds tension contributed 23 pounds toward stopping the ball, and the longer longitudinal strings at 100 pounds tension contributed 33.8 pounds in a load-bearing ratio of 4:6. The maximum string force applied to the ball is 56.8 pounds, which is about 92% of the peak force from the conventionally strung racket. This reduction in the maximum impact force reduces the ball deformation and increases the rebound velocity.

Test results have also confirmed the shock reduction capability of rackets strung according to the invention. Again, using as an example the Dunlop Volley II strung according to the invention as explained above, comparative test play by several professionals and experienced amateurs verifies that this racket is remarkedly shock free and suppresses vibration better than all other known rackets, including oversized rackets and graphite frame rackets. This can particularly benefit players who wish to avoid tennis elbow and want a racket that vibrates the least.

PRACTICAL LIMITS

Although longitudinal strings can extend all the way to the proximal end of the grip as explained in my grandparent application, calculations show that such long strings would require very high tensions exceeding the capacity of present string materials and racket frames. Nylon tennis racket strings cannot withstand tension more than about 90 pounds, and the upper limit for 17 gauge Kevlar is about 100 pounds. If more tension resistant string material is developed and stronger frame materials are available, then longitudinal strings can be lengthened into the handle to take full advantage of the invention.

Within the present limits for string and frame materials, a string network can be structured to emphasize either control or power. High string tension and moderate string length emphasize power and make the ball and network contact brief, which reduces control. Conversely, exceptionally long strings with moderately high tension increase the duration of ball and network contact to improve control and reduce shock at the expense of hitting power. The invention improves the network performance so that control, power, and shock reduction can all be enhanced; and the calculations aid in preselecting ways of emphasizing one of these characteristics.

Information developed by the invention suggests that for conventionally strung prior art rackets such as the Volley II or the Prince, simply uniformly increasing the tension of all the longitudinal strings in direct proportion to their length ratio will make the network too stiff on the sides and will reduce the size of the sweet spot. So to take advantage of the improvements produced by the invention, conventional longitudinal strings must be lengthened substantially relative to the transverse strings. Both calculations and experience show that the longitudinal strings in the central region should be at least 30% longer than the longest transverse string to achieve a worthwhile improvement. The longitudinal strings should also be strung with at least 30% more tension than the transverse strings, and the functional relationship between the longitudinal and transverse strings should be chosen to place about half or more of the ball-hitting load on the longitudinal strings.

To achieve the 30% minimum excess in length and tension for the longitudinal strings compared to the transverse strings requires lengthening the longitudinal strings by at least an inch or two for conventional rackets such as the Prince or Volley II. This can be done by converting the oval frame to an egg shape with the blunt end outward and the more pointed end toward the grip or by a modified throat piece that provides a string anchorage closer to the grip.

For example, a Prince racket with transverse strings strung at 70 pounds can have longitudinal strings fanning out from a throat piece one inch behind the present throat piece, and the greater length of these strings can be tensioned to the 90 pound limit of nylon to increase the ball-hitting load on the longitudinal strings from 43% to 47%. Field tests have shown that this 30% increase in the tension of the longitudinal strings over the cross strings makes a superior racket that is more playable, more responsive, and smooth; maintains the same control with added power to the center hits; and vibrates much less from off center hits.

Longitudinal strings tensioned at less than 30% more than the cross string tension do not produce a significant improvement if the corresponding length change is not appropriate. Also, longitudinal strings with at least 50% more tension than the transverse strings are clearly desirable, and this generally requires extending the longitudinal strings well into the throat or shank region of the racket. To take full advantage of the invention's possibilities for improvement, it is best to lengthen and tighten the longitudinal strings enough to apportion at least 50% and up to 65% of the ball-hitting load on the central longitudinal strings. The string network can also be varied to fit the styles of different players by emphasizing either power hitting or control and reduced shock.

STRING LENGTH LIMITATIONS

Since the parent application was filed, the International Tennis Confederation (ITC) in July 1981 adopted new rules restricting the length of tennis racket strings. As quoted from the Encyclopedia Britanica Book of the Year for 1982, the new rules say: "The hitting surface of the racket must consist of strings alternately interlaced or bonded where the frame including the handle shall not be longer than 32 inches (81 cm), or string surface exceed $15\frac{1}{2}\times11\frac{1}{2}$ inches ($39.4\times29.9$ cm) . . . ".

As applied to my invention, this rule may limit the length of longitudinal strings to $15\frac{1}{2}$ inches so that they cannot be strung to an anchorage adjacent the handle without violating the rule by being overly long. The anchorage for the longitudinal strings must then be positioned away from the grip and into the shank region to a point where the longest longitudinal strings will not exceed $15\frac{1}{2}$ inches.

Another effect of this rule is that if the longitudinal strings are fanned out across the string network as I prefer and if the racket is as wide as permitted, at least the two outermost longitudinal strings that extend along opposite sides of the network cannot be 30% longer than the longest transverse string. For example, the Prince Classic racket with a width of 10.75 inches and a maximum longitudinal string length of 15½ inches with fanned out longitudinal strings has two longitudinal strings on each side of the racket that are only 14% and 24% longer than the longest transverse string. Longitudinal strings strung parallel with each other, instead of being fanned out across the string network, can also produce side strings that are shorter than desirable.

To deal appropriately with longitudinal strings strung along the side of the network with lengths that do not exceed the length of the longest transverse string by at least 30% requires different tensioning. Overly tensioning side longitudinal strings that are inadequately long can make the sides of the string network too stiff and effectively narrow the high performance ball-hitting region.

It is possible to string different lengths of strings at different tensions and use three or more tensions on strings within the interlacing network. This can allow side longitudinal strings of intermediate length to be given intermediate tensions between the lower tension applied to transverse strings and the higher tension applied to central longitudinal strings. This would be especially desirable when two or more side longitudinal strings have an intermediate length and when the central longitudinal strings are strung with a tension exceeding the transverse string tension by 50% or more. Several intermediate strings at an intermediate tension would then fill a relatively wide tension gap between the central longitudinal strings and the transverse strings.

If only one or two side longitudinal strings falls slightly short of the desired goal of at least 30% greter length than the longest transverse string, an acceptable solution would be to string the side longitudinal strings at the same tension as the other longitudinal strings, particularly if this tension is only 30 to 40% more than the transverse string tension. As larger numbers of side longitudinal strings fall short of the 30% longer goal and as maximum and minimum tensions respectively for central longitudinal strings and transverse strings differ from each other by substantially more than the minimum goal of 30%, it is better to use an intermediate tension to smooth the tension transition from the two extremes.

Although the change in the rules reduces some of the options for keeping the longitudinal strings adequately long within the geometry of the shorter length limits now permitted by the rules, the general objective remains the same. This is to keep the longitudinal strings as long as possible and strung at suitably higher tensions so as to bear about half or more of the ball-hitting load. Side longitudinal strings may require tensioning at higher or lower values than their length would indicate, or intermediate tensions may be used for side longitudinal strings, but these circumstances do not change the general objective.

I claim:

1. A racket having a hand grip joined to a frame supporting a string network having transverse and longitudinal strings extending throughout a ball-hitting region spaced from said grip, said frame having a shank region extending from said grip and flaring outward in a throat region and a generally oval region extending around said ball-hitting region, said racket comprising:

a. at least a central plurality of said longitudinal strings having a strung length at least 30% longer than the longest transverse string in said network;

b. said central plurality of longer longitudinal strings including at least one-third of all the longitudinal strings in said ball-hitting region; and c. said longer longitudinal strings being strung with at least 30% more tension than said transverse strings.

2. The racket of claim 1 wherein said longer longitudinal strings extend at least into said throat region.

3. The racket of claim 2 wherein said longer longitudinal strings are arranged to fan outward across said ball-hitting region.

4. The racket of claim 2 including guide means in said throat region for angling said longer longitudinal strings between said shank region and said ball-hitting region.

5. The racket of claim 1 wherein said longer longitudinal strings are strung with at least 50% more tension than said transverse strings.

6. The racket of claim 1 wherein longitudinal strings shorter than said longer longitudinal strings are strung at an intermediate tension larger than the tension of said transverse strings.

7. The racket of claim 1 wherein said longer longitudinal strings bear from about half or more of the string force that decelerates a ball penetrating said string network in a central region occupied by said longer longitudinal strings.

8. The racket of claim 7 wherein said longer longitudinal strings extend at least into said throat region.

9. The racket of claim 8 wherein said longer longitudinal strings are strung with at least 50% more tension than said transverse strings.

10. The racket of claim 9 wherein said longer longitudinal strings are arranged to fan outward across said ball-hitting region.

11. The racket of claim 7 wherein longitudinal strings shorter than said longer longitudinal strings are strung at an intermediate tension larger than the tension of said transverse strings.

* * * * *